US008296911B1

(12) United States Patent
Pruitt et al.

(10) Patent No.: US 8,296,911 B1
(45) Date of Patent: Oct. 30, 2012

(54) SHIFTED ANGLE FABRIC

(75) Inventors: Jimmy L. Pruitt, Hickory, NC (US); Charles Albert Watson, Jr., High Point, NC (US)

(73) Assignee: Highland Industries, Inc., Kernersville, NC (US)

( * ) Notice: Subject to any disclaimer, the term of this patent is extended or adjusted under 35 U.S.C. 154(b) by 367 days.

(21) Appl. No.: 12/553,154

(22) Filed: Sep. 3, 2009

(51) Int. Cl.
*D06C 3/00* (2006.01)

(52) U.S. Cl. ..... 26/51.3

(58) Field of Classification Search ..... 26/51.3, 26/51.4, 96, 89, 71, 72–74, 93, 106, 51.5, 26/52.53, 91; 264/288.4, 288.8, 290.2; 28/157; 34/658, 660, 662, 623, 464, 465, 459, 646, 34/60

See application file for complete search history.

(56) References Cited

U.S. PATENT DOCUMENTS

| | | | | | |
|---|---|---|---|---|---|
| 848,416 | A | * | 3/1907 | Voland et al. | 26/51.3 |
| 1,504,255 | A | | 8/1924 | MacDonald | |
| 1,607,266 | A | * | 11/1926 | Lough | 442/15 |
| 1,763,569 | A | * | 6/1930 | Van Orman | 26/51.3 |
| 2,071,015 | A | * | 2/1937 | Andrews | 34/464 |
| 2,083,141 | A | * | 6/1937 | Buck | 34/82 |
| 2,209,220 | A | * | 7/1940 | Berry | 26/51.5 |
| 2,574,083 | A | * | 11/1951 | Andrews | 34/646 |
| 2,746,117 | A | * | 5/1956 | Ainsworth | 26/93 |
| 2,985,941 | A | * | 5/1961 | Riedesel et al. | 428/112 |
| 3,146,511 | A | * | 9/1964 | Hoffman | 26/51.4 |
| 3,590,450 | A | * | 7/1971 | Pernick | 26/51.3 |
| 3,890,421 | A | * | 6/1975 | Habozit | 264/290.2 |
| 4,015,318 | A | * | 4/1977 | Hakanson | 28/165 |
| 4,034,702 | A | | 7/1977 | Shirasaka et al. | 118/34 |
| 4,055,697 | A | * | 10/1977 | Schmanski | 428/113 |
| 4,097,621 | A | | 6/1978 | Shirasaka et al. | 427/173 |
| 4,501,771 | A | | 2/1985 | Long | 427/176 |
| 4,570,566 | A | | 2/1986 | Long | 118/34 |
| 4,637,103 | A | * | 1/1987 | Hutzenlaub | 26/73 |
| 4,807,336 | A | * | 2/1989 | Yoshimura et al. | 26/73 |
| 4,817,254 | A | * | 4/1989 | Poterala | 26/51.3 |
| 4,887,656 | A | * | 12/1989 | Verbauwhede et al. | 152/531 |
| 4,894,891 | A | * | 1/1990 | Beckstein | 26/51.4 |
| 5,068,000 | A | | 11/1991 | Lauderdale | 156/148 |
| 5,255,419 | A | * | 10/1993 | Stanislaw et al. | 26/89 |
| 6,746,633 | B2 | * | 6/2004 | Sakamaki et al. | 264/1.34 |
| 8,028,383 | B2 | * | 10/2011 | Sano et al. | 26/73 |
| 8,037,583 | B2 | | 10/2011 | Davis | 26/51 |
| 2004/0052937 | A1 | * | 3/2004 | Ito et al. | 427/162 |
| 2006/0115610 | A1 | * | 6/2006 | Nagashima | 428/1.3 |
| 2011/0290177 | A1 | | 12/2011 | Davis | 118/34 |

FOREIGN PATENT DOCUMENTS

| | | | | |
|---|---|---|---|---|
| JP | 2000-009912 | A | * | 1/2000 |
| JP | 2002-22944 | A | * | 1/2002 |

* cited by examiner

*Primary Examiner* — Amy Vanatta
(74) *Attorney, Agent, or Firm* — MacCord Mason PLLC

(57) ABSTRACT

An apparatus and method for producing a shifted angle fabric and the product produced thereby. The apparatus includes a supply of fabric and a differential tenter frame. The differential tenter frame includes a frame, a pair of opposed, constant path rails and a differential drive. The differential tenter frame is located downstream from the supply of fabric for receiving the opposing edges of the fabric and advancing the opposing edges at different speeds to shift the weft angle of the fabric as the fabric travels the length of the differential tenter frame. A high velocity, low heat drying range adjacent to the differential tenter frame simultaneously dries the fabric as the fabric travels the length of the differential tenter frame. A take-up roll downstream from the differential tenter frame then takes up the dried fabric.

53 Claims, 8 Drawing Sheets

$C_1 < C_2$ in Warp (Drying / % Rebound)

SHIFTED ANGLE FABRIC

BACKGROUND OF THE INVENTIONS (1) Field

The present inventions relate generally to an apparatus for producing a shifted angle fabric and, more particularly, to an apparatus and method for producing a shifted angle fabric having balanced crimp and the product produced thereby.

(2) Related Art

Conventional woven fabrics are produced with lengthwise warp yarns and crosswise weft yarns interlaced at an angle of 90 degrees. For some applications, including power transmission belts, tires, and hoses, it is useful to rotate the fabric by cutting diagonally and turning the cut panels so that the warp and weft yarns are disposed at ±45 degrees relative to the longitudinal axis of the product. This biased fabric will exhibit increased elongation under load compared to the original fabric orientation.

It has previously been found that, prior to biasing, the elongation properties can be further increased by altering the angle of the warp/weft yarns from the as-woven 90/90 degrees (e.g. 110/80 degrees or 120/70 degrees) by shifting the weft yarn while keeping the warp yarn in its original straight and parallel orientation. The shifted angle fabric is then cut and turned using the conventional biasing techniques so that the obtuse angle is oriented in the machine direction, thereby increasing the elongation properties of the fabric when placed under load. This shifting process has been conducted using various methods so that one selvage of the woven fabric is advanced relative to the opposite selvage.

One commonly used method involves passing wetted-out woven fabric over one or more pairs of angled and tapered rollers followed by drying the fabric on a conventional clip-tenter frame through a dryer. This method typically produces a shifted angle fabric with substantially unbalanced crimp and elongation properties in the warp yarn direction compared to the weft yarn direction. Additionally, shifted angle fabric produced by this method will exhibit an undesirable variation in warp yarn crimp and elongation when comparing measurements taken at different points across the width of the fabric, and variation in warp-weft crossover angle measured at different points across the width of the fabric.

Another method involves use of a specially built tenter frame and dryer with rails arranged in a laterally curved path. The equipment used in this method must be custom made at considerable expense, and cannot be used for processing other types of fabrics.

Thus, there remains a need for a new and improved apparatus which is adapted to produce a shifted angle fabric while, at the same time, producing balanced crimp and the product produced thereby.

SUMMARY OF THE INVENTIONS

The present inventions are directed to an apparatus and method for producing a shifted angle fabric and the product produced thereby. The apparatus includes a supply of fabric and a differential tenter frame. The differential tenter frame includes a frame, a pair of opposed, constant path rails and a differential drive. The differential tenter frame is located downstream from the supply of fabric for receiving the opposing edges of the fabric and advancing the opposing edges at different speeds to shift the weft angle of the fabric as the fabric travels the length of the differential tenter frame. A high velocity, low heat drying range adjacent to the differential tenter frame simultaneously dries the fabric as the fabric travels the length of the differential tenter frame. A take-up roll downstream from the differential tenter frame then takes up the dried fabric.

Preferably, the differential tenter frame is a pin tenter. Also, preferably the differential drive is a variable speed differential drive. The variable speed differential drive may include an AC convertor control system for controlling the speed of the drive.

The differential drive preferably provides a speed differential wherein one opposing edge is between about 25% and about 100% of the width of the fabric trailing the other opposing edge, whereby a shifted angle between about 105° and about 135° is formed. Preferably, the differential drive provides a speed differential wherein one opposing edge is between about 35% of the width of the fabric trailing the other opposing edge whereby a shifted angle between about 110° is formed.

Preferably, the high velocity, low heat drying range dries the fabric to between about 1 wt. % and about 5 wt. % at the exit from the range. Most preferably, the high velocity, low heat drying range dries the fabric to between about 4 wt. % and about 5 wt. % at the exit from the range. A moisture sensor may be located adjacent to the exit of the high velocity, low heat drying range for measuring the weight percent moisture of the fabric as it exits the range.

The apparatus may further include a trimming station upstream of the take-up roll and downstream from the differential tenter frame. In addition, the apparatus may further include a coating range downstream from the take-up roll. The coating range preferably includes a nip roll assembly, which applies a Resorcinol-Formaldehyde-Latex (RFL) coating to the fabric.

The fabric preferably is a woven fabric and, most preferably, the fabric is a cotton/synthetic blend. The cotton/synthetic blend may be between about 30/70 and about 55/45 cotton/synthetic. Preferably, the blend is about 55/45 cotton/synthetic. Also, preferably, the cotton/synthetic blend is a cotton/nylon blend.

The woven fabric preferably is a square weave construction. Preferably, the square weave is about a 36 by 36 square weave construction.

A fixative may be used to stabilize the fabric. Preferably, the fixative is applied by treating the yarn of the fabric with starch. Most preferably, the starch fixative is associated with yarn in the warp. The starch fixative is re-wetable to allow the fabric to move as the fabric travels the length of the differential tenter frame and thereby ties the warp and weft yarns together as the fabric is dried.

The above apparatus produces a shifted angle woven fabric, wherein the fabric is shifted between about 110 degrees and about 125 degrees and wherein the crimp of the fabric is substantially equal in both the warp and weft directions. Preferably, the fabric is shifted about 112 degrees.

Preferably, the ratio of warp crimp to weft crimp of the fabric is between about 0.5 and about 1.5 when crimp is measured according to ASTM-3883:1990. Preferably, the ratio of warp crimp to weft crimp of the fabric is about 0.9. Also, preferably the crimp of the fabric is between about 3% and about 10% in both the warp and weft directions.

The elongation value of the fabric preferably is between about 35% and about 55% when tested according to ASTM-5034:1995. Preferably, the elongation value of the fabric is about 55%.

Accordingly, one aspect of the present inventions is to provide an apparatus for producing a shifted angle fabric, the apparatus including: (a) a supply of fabric; (b) a differential tenter frame downstream from the supply of fabric for receiving the fabric and advancing the opposing edges of the fabric at different speeds to shift the weft angle of the fabric as the fabric travels the length of the differential tenter frame; and (c) a drying range for simultaneously setting the fabric at the shifted weft angle of the fabric as the fabric travels the length of the differential tenter frame.

Another aspect of the present inventions is to provide an apparatus for producing a shifted angle fabric from a supply of pre-formed fabric, the apparatus including: (a) a differential tenter frame including (i) a frame, (ii) a pair of opposed, constant path rails and (iii) a differential drive, the differential tenter frame located downstream from the supply of fabric for receiving the opposing edges of the fabric and advancing the opposing edges at different speeds to shift the weft angle of the fabric as the fabric travels the length of the differential tenter frame; and (b) a high velocity, low heat drying range for simultaneously drying the fabric as the fabric travels the length of the differential tenter frame.

Another aspect of the present inventions is to provide an apparatus for producing a shifted angle fabric, the apparatus including: (a) a supply of fabric; (b) a differential tenter frame including (i) a frame, (ii) a pair of opposed, constant path rails and (iii) a differential drive, the differential tenter frame located downstream from the supply of fabric for receiving the opposing edges of the fabric and advancing the opposing edges at different speeds to shift the weft angle of the fabric as the fabric travels the length of the differential tenter frame; (c) a high velocity, low heat drying range for simultaneously drying the fabric as the fabric travels the length of the differential tenter frame; and (d) a take-up roll downstream from the differential tenter frame for taking up the dried fabric.

Another aspect of the present inventions is to provide a method for producing a shifted angle fabric, the method including the steps of: supplying a fabric; receiving the fabric and advancing the opposing edges of the fabric at different speeds to shift the weft angle of the fabric; and simultaneously setting the fabric at the shifted weft angle of the fabric.

Still another aspect of the present inventions is to provide a shifted angle woven fabric, wherein the fabric is shifted between about 110 degrees and about 125 degrees and wherein the crimp of the fabric is substantially equal in both the warp and weft directions.

These and other aspects of the present inventions will become apparent to those skilled in the art after a reading of the following description of the preferred embodiment when considered with the drawings.

BRIEF DESCRIPTION OF THE DRAWINGS

FIG. 1 represents a plain weave fabric wherein the warp and weft of yarns are intersecting orthogonally with one another;

DESCRIPTION OF THE PREFERRED EMBODIMENTS

Figure 1:
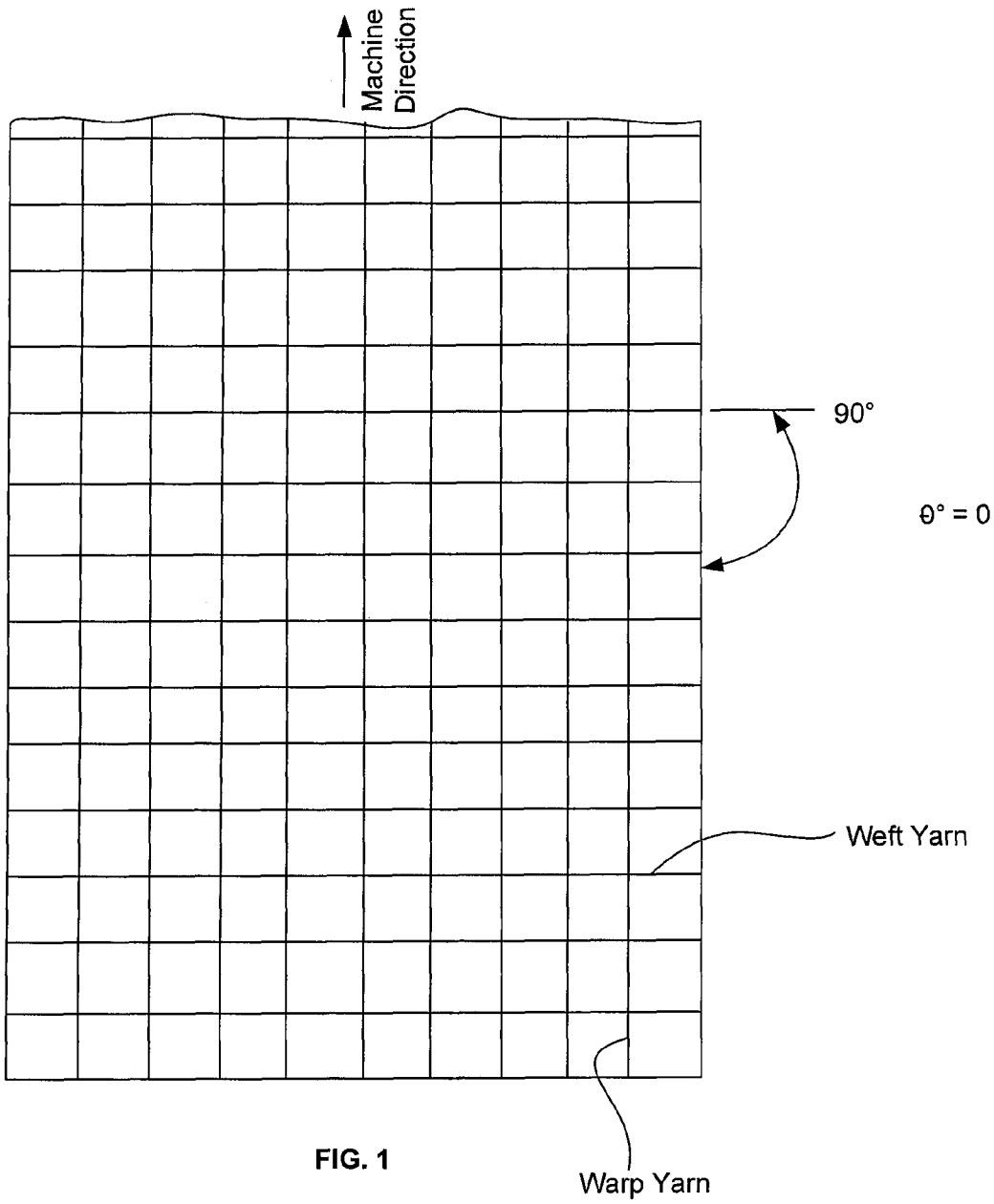
FIG. 1 is a block diagram illustrating a tank monitor and inventory control system constructed according to the present inventions.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the inventions and are not intended to limit the inventions thereto. As best seen in FIG. 1, there is shown a plain weaved fabric wherein the warp and weft yarns are intersected orthogonally with respect to one another. This is a conventional construction used for many textile articles because of its flexibility and patterns and choice of both warp and weft yarns.

For some applications including power transmission belts, tires and hoses, it is useful to rotate the fabric by cutting diagonally and turning the cut panels so that the warp and weft yarns are disposed at ±45 degrees relative to the longitudinal axis of the product. This biased fabric will exhibit increased elongation under load compared to the original fabric orientation. It has previously been found that, prior to biasing, elongation properties can be increased by altering the angle of the warp/weft yarns from the as-woven 90/90 degrees (e.g., 110/80 degrees or 120/70 degrees) by shifting the weft yarn, while keeping the warp yarn in its original straight and parallel orientation with respect to the machine direction (i.e. warp yarn angle with respect to machine direction remains substantially zero) as best seen in FIG. 2.

Because the warp yarn angle remains substantially zero, the shifted angle fabric can be further processed, if desired, by equipment which can not normally be used to process shifted angle fabric. For example, calendaring a conventional shifted angle fabric, in which the warp yarns are not substantially zero with respect to machine direction, will damage the rubber coated fabric as the warp yarns in the coated fabric try to align themselves with respect to the machine direction of the calendaring machine.

Figure 2:
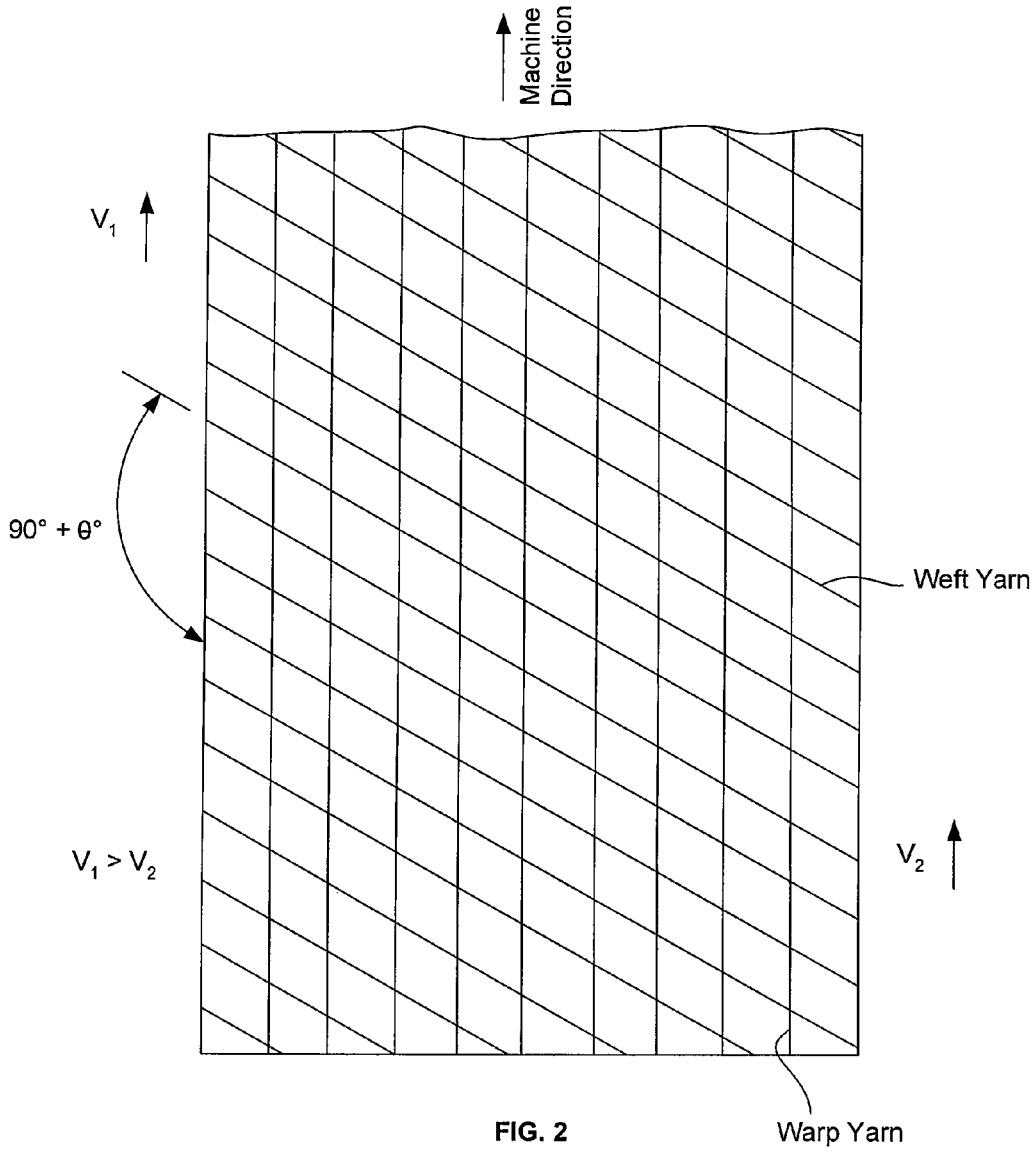
FIG. 2 represents the fabric in FIG. 1 after the fabric angles have been shifted.

However, as seen in FIG. 2, the warp yarns of a shifted angle fabric produced according to the present inventions is aligned in the machine direction and, therefore, can be coated and calendered without damage. After calendaring, the coated shifted angle fabric can be cut and turned using conventional biasing techniques so that the obtuse angle is oriented in the machine direction, thereby increasing the elongation properties of the fabric when placed under load.

Figure 3:
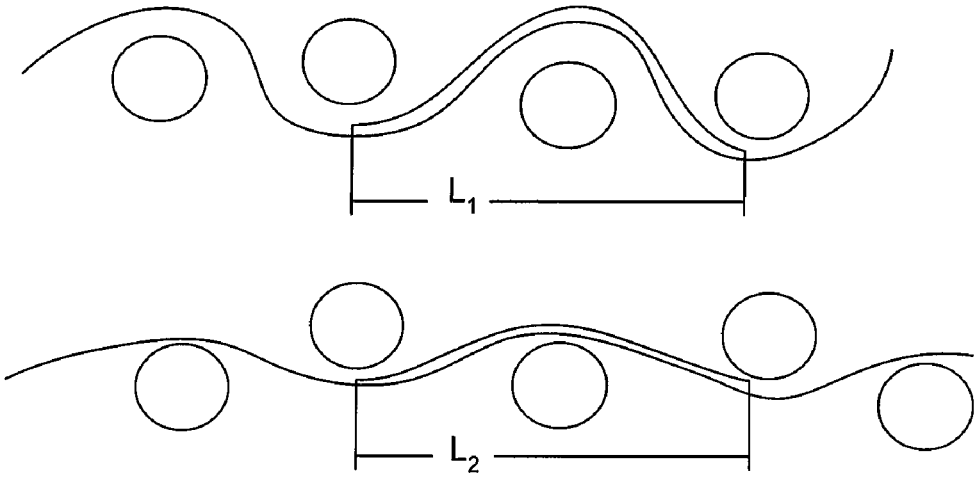
FIG. 3 is a schematic representation illustrating crimp in the warp yarns caused by conventional distortion using constant speed/variable distance, rollers or rails.

As can be further appreciated from FIG. 3, moving either the edges of the fabric, a portion of the fabric or the entire width of the fabric at different distances using unequal length rails or angled and tapered rollers produces unbalanced warp and weft yarn crimp (i.e. C1<C2 in warp) and elongation in a shifted angle fabric. It also can produce varying warp yarn crimp and elongation across the width of the shifted angled fabric. This also may result in a varying warp-weft crossover angle that can be caused by shifting angle of the fabric along a curved weft yarn path. Such variations introduce other variations in subsequent handling of the shifted angle fabric and in the processing of the shifted angle fabric. This often produces variations in physical properties of the final products produced from such fabrics even when the fabric is cut from the same roll because of the variations occur over the width of the fabric and not just along the length of the fabric.

Figure 4:
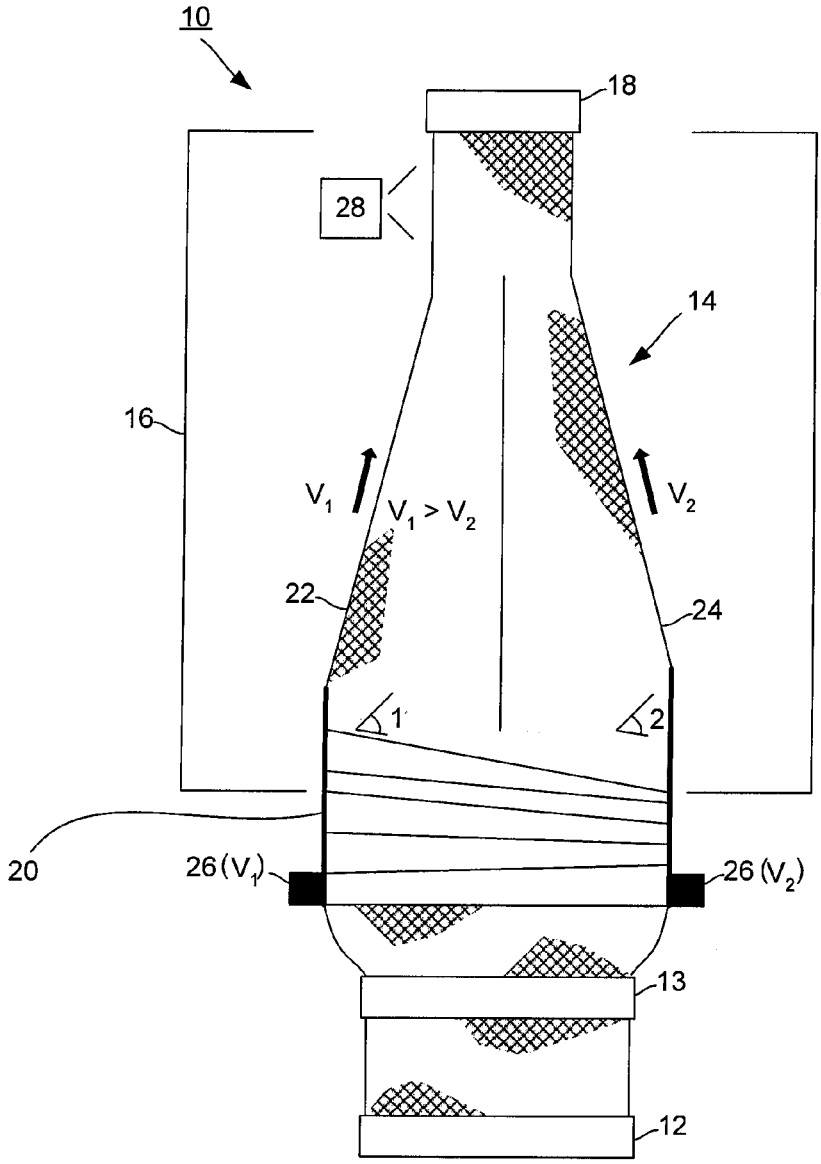
FIG. 4 is a general plan view of a differential tenter frame and drying range for an apparatus constructed according to the present inventions.

Turning to FIG. 4, there is shown a general plan view of an apparatus constructed according to the present inventions, generally designated 10. The apparatus 10 includes a differential tenter frame 14 and drying range 16. A supply of pre-woven fabric 12 is overfed into differential tenter frame 14 and subsequently dried by the high velocity, low heat drying range 16 prior to being taken up by take-up roll 18.

The differential tenter frame 14 is a modified, conventional straight pin/tenter frame and includes a frame 20, a pair of opposed rails 22, 24 and a differential drive 26. The differential tenter frame 14 provides lengthwise overfeed capacity. The differential drive 26 provides independent drive control of each of the opposing tenter chains along rails 22,24. In addition, the opposing rails 22,24 are adapted to taper towards one another to reduce the distance (width) between the rails 22,24 as the fabric progresses along the length of the differential tenter frame 14. This is important because as the fabric is shifted and the angle of the weft yarns increases with respect to the warp yarns, the distance between the rails 22,24 must be closer together to allow the weft yarns to bridge this distance and to maintain control of the tension of the weft yarns.

Preferably, the differential drive 26 is a variable speed differential drive. The variable speed differential drive may include an AC convertor control system for controlling the speed of the drive.

The differential drive 26 preferably provides a speed differential wherein one opposing edge is between about 25% and about 100% of the velocity of the fabric trailing the other opposing edge, whereby a shifted angle between about 105 degrees and about 135 degrees is formed. Preferably, the differential drive 26 provides a speed differential, wherein one opposing edge is about 35% of the velocity of the fabric trailing the other opposing edge, whereby a shifted angle of about 110 degrees is formed.

In operation, the weft yarns are shifted by advancing one selvage of the fabric faster relative to the opposing selvage of the fabric, by driving one tenter chain at a faster speed than the opposing tenter chain. Fabric overfeed capability, combined with the width taper of the tenter rails 22,24 allows for precise control of warp and weft yarn crimp and elongation. At the same time, control of the drying range 16 with respect to the speed of the differential tenter frame 14 allows for simultaneous shifting of the weft yarns and drying or setting of the shifted angle fabric as the fabric progresses through the tenter/dryer combination, thereby eliminating the need for separate shifting and drying equipment. The interplay between the tenter frame speed and dryer moisture removal rate as will be better understood by the discussion of the graphs shown in FIGS. 5 and 6 below.

Preferably, the high velocity, low heat drying range 16 dries the fabric to between about 1 wt. % and about 5 wt. % at the exit from the range. Most preferably, the high velocity, low heat drying range 16 dries the fabric to between about 4 wt. % and about 5 wt. % at the exit from the range. A moisture sensor 28 may be located adjacent to the exit of the high velocity, low heat drying range 16 for measuring the weight percent moisture of the fabric as it exits drying range. One suitable sensor is a Model 9900 moisture sensor available from Strandberg Engineering Laboratories, Inc. of Greensboro, N.C.

Figure 5:
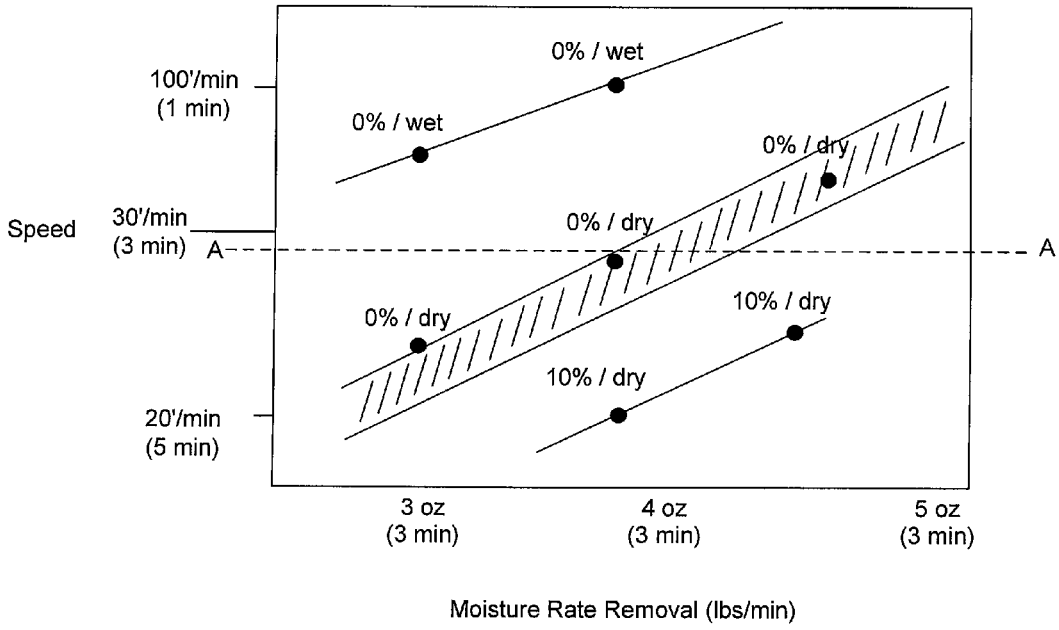
FIG. 5 is a graphical representation of a response surface illustrating rebound/wetness as a function of tenter-frame speed (ft/min) and moisture rate removal (lbs/min)

Turning first to FIG. 5, there is shown a graphical representation of a response surface illustrating rebound/wetness as a function the speed (ft/min) of differential tenter frame 14 and moisture rate removal (lbs/min) of the high velocity low heat drying range 16. As can be seen from the response surface shown in FIG. 5, there is a very narrow range of both speed and moisture rate removal, wherein the shifted angle fabric is sufficiently dry that it may be taken up without the problems of mildew and mold caused by excessive moisture. But, at the same time, not so dry that the shifted angle fabric is dried prior to coming to the end of the differential tenter frame 16. As can be appreciated, if the shifted angle fabric is dried too early while its selvage is still moving at two different speeds, rebound will be introduced into the fabric. Such fabrics will try to return to the lower shifted angle that it was set at when dried, instead of remaining at the angle that it was taken off of the differential tenter frame 14.

Figure 6:
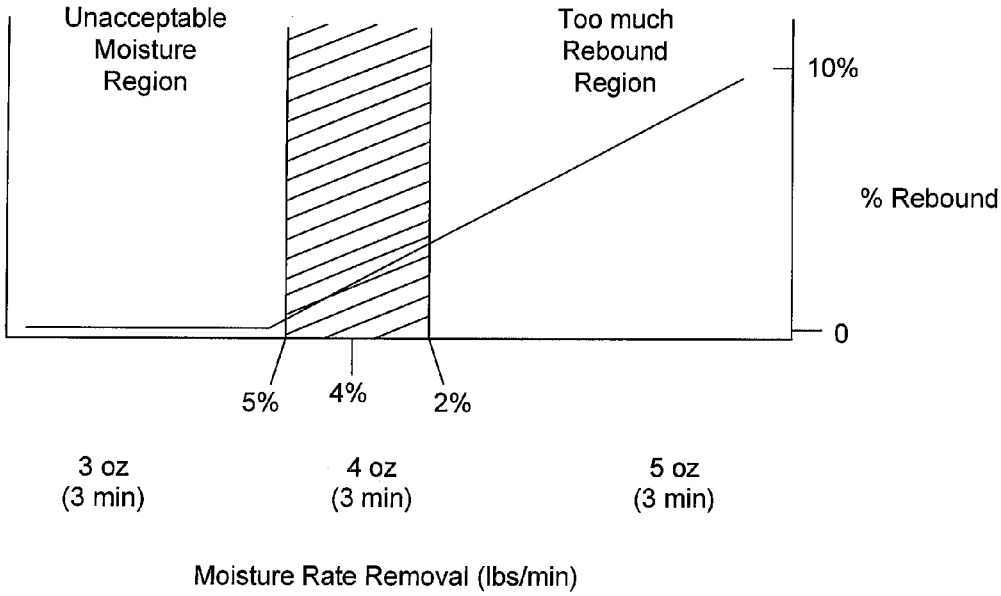
FIG. 6 is a graphical representation taken along line A-A of FIG. 5 at a tenter frame speed of 30 ft/min illustrating the percent rebound/wetness as a function of moisture rate removal (lbs/min)

For illustrative purposes, the graph in FIG. 6 shows the results at a constant speed of 30 ft/min for a 100 foot differential tender frame 14 taken along the line A-A of FIG. 5. For most applications a moisture content of about 4 wt. %±1 wt. % is satisfactory. Below that moisture value, the percent rebound of the shifted angle fabric increases rapidly since the shifted angle fabric is becoming set by the drying progresses. Thus, there is only a very narrow set of operating conditions for the differential tenter frame 14 and the drying range 16 that will produce both acceptable dryness and low rebound in the shifted angle fabric.

Figure 7:
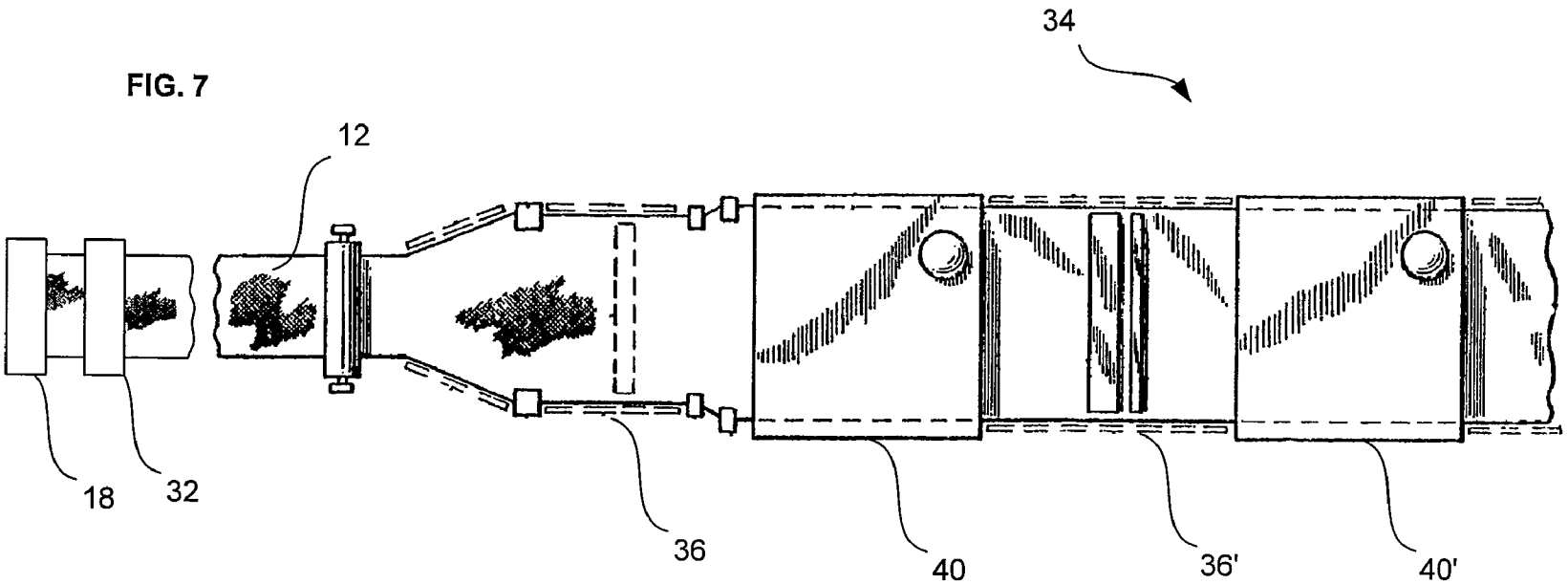
FIG. 7 is a general plan view of the shifted angle fabric coating range downstream of the apparatus shown in FIG. 4.

After being taken up on take-up roll 18, the shifted angled fabric is further processed as shown in FIG. 7. FIG. 7 is a generally conventional coating range such as described in U.S. Pat. Nos. 4,570,566, 4,501,771 and 4,753,823, which are hereby incorporated by reference in their entirety. FIG. 7 may include a trimming station 32 upstream of coating range 34. Trimming station 32 which also may be located upstream of take-up roll 18 if desired. Coating range 34 is located downstream of take-up roll 18 and trimming station 32 for receiving of the shifted angled fabric and passing it through one or more nip roll coater assemblies 36, 36' which apply a Resorcinol-Formaldehyde-Latex (RFL) coating 38 to the fabric. Cure ovens 40, 40' downstream of each coater assemblies 36, 36' dry the RFL coating 38. A single coater assembly 36 may also be used for some applications.

The fabric which is produced according to the present inventions is preferably a woven fabric. Preferably, the fabric is a cotton/synthetic blend. The cotton/synthetic blend may be between about 30/70 and about 55/45 cotton/synthetic. Preferably, the blend is about 55/45 cotton/synthetic. Also, preferably, the cotton/synthetic blend is a cotton/nylon blend.

The woven fabric preferably is a square weave construction. Preferably, the square weave is about a 36 by 36 square weave construction.

Furthermore, a fixative may be used to stabilize the supply of pre-woven fabric 12 prior to shifting the angle of the fabric and a portion may remain on the shifted angle fabric after drying to provide additional stability during subsequent handling and processing. Preferably, the fixative is applied by treating the yarn of the fabric with starch. Most preferably, the starch fixative is associated with yarn in the warp. The starch fixative is re-wetable as the fabric is overfed into differential tenter frame 14 to allow the weft yarns of the fabric to move as the fabric travels the length of the differential tenter frame 14 and thereby may be used to tie the warp and weft yarns together as the fabric is dried.

Figure 8:
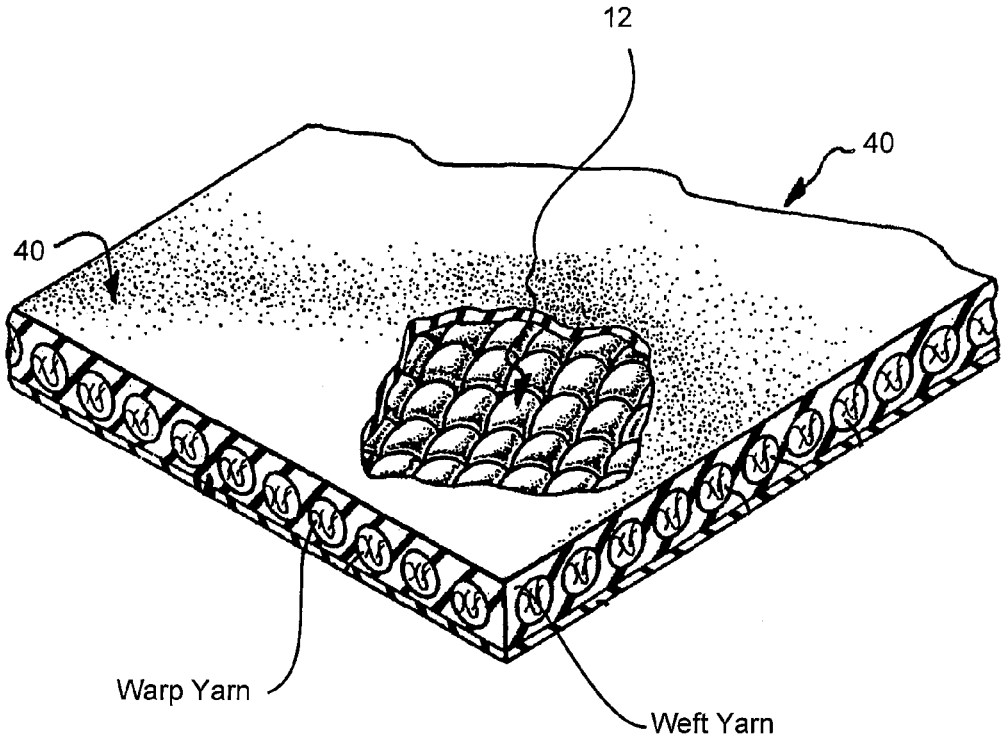
FIG. 8 is a fragmentary view of a coated shifted angle fabric formed according to the present inventions.

Finally, turning to FIG. 8 there is shown a fragmentary view of a coated shifted angled fabric construction according to the present inventions. The above described apparatus produces a shifted angle woven fabric, wherein the fabric is shifted between about 110 degrees and about 125 degrees and wherein the crimp of the fabric is substantially equal in both the warp and weft directions. Preferably, the fabric is shifted about 112 degrees.

Preferably, the ratio of warp crimp to weft crimp of the fabric is between about 0.5 and about 1.5 when crimp is measured according to ASTM-3883-90 (1990). Preferably, the ratio of warp crimp to weft crimp of the fabric is about 0.9. Also, preferably the crimp of the fabric is between about 3% and about 10% in both the warp and weft directions.

The elongation value of the fabric preferably is between about 35% and about 55% when tested according to ASTM-5034-95 (1995). Preferably, the elongation value of the fabric is about 55%.

Thus, the present inventions provide for the use of a modified, conventional straight-path tenter frame which reduces equipment expense and improves the versatility of the equipment since it can produce a wide range of shifted angle fabrics without requiring changing rails or rollers but by changing the relative speeds of edges of the fabric in the differential tenter frame 14 and by adjusting the width between opposing rails 22,24. In addition, simultaneous shifting and drying/setting of the fabric allows for precise control of warp-weft angle as well as warp and weft yarn crimp and elongation balance. Also, constant control of weft tension by controlling the width between opposing rails 22,24 during the shifting process, eliminates curved weft yarn and the resulting variation in warp-weft angle. Finally, gradual skewing of the weft yarn over the considerable length of the tenter frame 16 as compared to prior art curved rails or tapered rollers, reduces side-to-side variation in warp yarn crimp and elongation to a negligible level.

As a result of being able to balance the crimp between the well and warp yarns in the shifted angle fabric, belting and similar products produced according to the present inventions have been found to track much better than products constructed from shifted angle fabric having unbalanced crimp between the weft and yarns.

Certain modifications and improvements will occur to those skilled in the art upon a reading of the foregoing description. By way of example, using a single angle taper of just one of the two opposing rails instead of tapering both rails towards one another could improve the linearity of the weft at the shifted angle. Also, the addition of steam heated rolls at the exit of the drying range could improve stability and dryness following pin extraction on the tenter frame. It should be understood that all such modifications and improvements have been deleted herein for the sake of conciseness and readability but are properly within the scope of the following claims.

I claim:

1. An apparatus for producing a shifted angle fabric, said apparatus comprising:

(a) a supply of fabric;

(b) a differential tenter frame downstream from said supply of fabric for receiving the fabric and advancing the opposing edges of the fabric at different speeds to shift a weft angle of the fabric as the fabric travels the length of said differential tenter frame, said tenter frame including a pair of opposing rails, each tapered towards one another; and (c) a drying range for simultaneously setting the fabric at the shifted weft angle of the fabric as the fabric travels the length of said differential tenter frame.

2. The apparatus according to claim 1 further including a take-up roll downstream from said differential tenter frame for taking up the dried fabric.

3. The apparatus according to claim 2 further including a trimming station upstream of said take-up roll and downstream from said differential tenter frame.

4. The apparatus according to claim 2 further including a coating range downstream from said take-up roll.

5. The apparatus according to claim 4, wherein said coating range includes a nip roll assembly.

6. The apparatus according to claim 5, wherein said coating range applies a Resorcinol-Formaldehyde-Latex (RFL) coating.

7. The apparatus according to claim 1, wherein the fabric is a woven fabric.

8. The apparatus according to claim 7, wherein the fabric is a cotton/synthetic blend.

9. The apparatus according to claim 8, wherein the cotton/synthetic blend is between about 30/70 and about 55/45 cotton/synthetic.

10. The apparatus according to claim 8, wherein the cotton/synthetic blend is about 55/45 cotton/synthetic.

11. The apparatus according to claim 8, wherein said cotton/synthetic blend is a cotton/nylon blend.

12. The apparatus according to claim 7, wherein said woven fabric is a square weave construction.

13. The apparatus according to claim 12, wherein said square weave is about a 36 by 36 square weave construction.

14. The apparatus according to claim 1 further including a fixative to stabilize the fabric.

15. The apparatus according to claim 14, wherein said fixative is applied by treating the yarn of said fabric with starch.

16. The apparatus according to claim 15, wherein said starch fixative is associated with yarn in the warp.

17. The apparatus according to claim 16, wherein said starch fixative is re-wetable to allow the fabric to move as the fabric travels the length of said differential tenter frame and thereby ties the warp and weft yarns together.

18. An apparatus for producing a shifted angle fabric from a supply of pre-formed fabric, said apparatus comprising:

(a) a differential tenter frame including (i) a frame, (ii) a pair of opposing rails, each tapered towards one another and (iii) a differential drive, said differential tenter frame located downstream from the supply of fabric for receiving the opposing edges of the fabric and advancing the opposing edges at different speeds to shift a weft angle of the fabric as the fabric travels the length of said differential tenter frame; and (b) a high velocity, drying range for simultaneously drying the fabric as the fabric travels the length of said differential tenter frame.

19. The apparatus according to claim 18, wherein said differential tenter frame is a pin tenter.

20. The apparatus according to claim 18, wherein said differential drive is a variable speed differential drive.

21. The apparatus according to claim 20, wherein said variable speed differential drive includes an AC convertor control system for controlling the speed of said drive.

22. The apparatus according to claim 18, wherein said differential drive provides a speed differential, wherein one opposing edge is between about 25% and about 100% of the width of the fabric trailing the other opposing edge, whereby a shifted angle between about 105° and about 135° is formed.

23. The apparatus according to claim 22, wherein said differential drive provides a speed differential, wherein one opposing edge is about 35% of the width of the fabric trailing the other opposing edge, whereby a shifted angle about 110° is formed.

24. The apparatus according to claim 18, wherein said high velocity, drying range dries the fabric to between about 1 wt. % and about 5 wt. % at the exit from said range.

25. The apparatus according to claim 24, wherein said high velocity, drying range dries the fabric to between about 4 wt. % and about 5 wt. % at the exit from said range.

26. The apparatus according to claim 18 further including a moisture sensor located adjacent to the exit of said high velocity, drying range for measuring the weight percent moisture of the fabric as it exits the range.

27. An apparatus for producing a shifted angle fabric, said apparatus comprising:

(a) a supply of fabric;

(b) a differential tenter frame including (i) a frame, (ii) a pair of opposing rails, each tapered towards one another; and (iii) a differential drive, said differential tenter frame located downstream from the supply of fabric for receiving the opposing edges of the fabric and advancing the opposing edges at different speeds to shift a weft angle of the fabric as the fabric travels the length of said differential tenter frame;

(c) a high velocity, drying range for simultaneously drying the fabric as the fabric travels the length of said differential tenter frame; and (d) a take-up roll downstream from said differential tenter frame for taking up the dried fabric.

28. The apparatus according to claim 27 further including a trimming station upstream of said take-up roll and downstream from said differential tenter frame.

29. The apparatus according to claim 27 further including a coating range downstream from said take-up roll.

30. The apparatus according to claim 29, wherein said coating range includes a nip roll assembly.

31. The apparatus according to claim 30, wherein said coating range applies a Resorcinol-Formaldehyde-Latex (RFL) coating.

32. The apparatus according to claim 27, wherein the fabric is a woven fabric.

33. The apparatus according to claim 32, wherein the fabric is a cotton/synthetic blend.

34. The apparatus according to claim 33, wherein the cotton/synthetic blend is between about 30/70 and about 55145 cotton/synthetic.

35. The apparatus according to claim 34, wherein the cotton/synthetic blend is about 55/45 cotton/synthetic.

36. The apparatus according to claim 32, wherein said cotton/synthetic blend is a cotton/nylon blend.

37. The apparatus according to claim 32, wherein said woven fabric is a square weave construction.

38. The apparatus according to claim 37, wherein said square weave is about a 36 by 36 square weave construction.

39. The apparatus according to claim 27 further including a fixative to stabilize the fabric.

40. The apparatus according to claim 39, wherein said fixative is applied by treating the yarn of said fabric with starch.

41. The apparatus according to claim 40, wherein said starch fixative is associated with yarn in the warp.

42. The apparatus according to claim 41, wherein said starch fixative is re-wetable to allow the fabric to move as the fabric travels the length of said differential tenter frame and thereby ties the warp and weft yarns together.

43. The apparatus according to claim 27, wherein said differential tenter frame is a pin tenter.

44. The apparatus according to claim 27, wherein said differential drive is a variable speed differential drive.

45. The apparatus according to claim 44, wherein said variable speed differential drive includes an AC convertor control system for controlling the speed of said drive.

46. The apparatus according to claim 27, wherein said differential drive provides a speed differential, wherein one opposing edge is between about 25% and about 100% of the width of the fabric trailing the other opposing edge, whereby a shifted angle between about 105° and about 135° is formed.

47. The apparatus according to claim 46, wherein said differential drive provides a speed differential, wherein one opposing edge is about 35% of the width of the fabric trailing the other opposing edge, whereby a shifted angle about 110° is formed.

48. The apparatus according to claim 27, wherein said high velocity, drying range dries the fabric to between about 1 wt. % and about 5 wt. % at the exit from said range.

49. The apparatus according to claim 48, wherein said high velocity, drying range dries the fabric to between about 4 wt. % and about 5 wt. % at the exit from said range.

50. The apparatus according to claim 27 further including a moisture sensor located adjacent to the exit of said high velocity, drying range for measuring the weight percent moisture of the fabric as it exits the range.

51. A method for producing a shifted angle fabric, said method comprising the steps of:

supplying a fabric;

receiving the fabric on a differential tenter frame having a pair of opposing rails, and advancing the opposing edges of the fabric at different speeds to shift a weft angle of the fabric;

reducing the distance between the opposing edges of the fabric as the weft angle of the fabric is shifted by the pair of opposing rails, each tapered towards one another; and simultaneously setting the fabric at the shifted weft angle of the fabric.

52. A method for producing a shifted angle fabric from a supply of pre-formed fabric, said method comprising the steps of:

receiving the opposing edges of the fabric on a differential tenter frame having a pair of opposing rails, and advancing the opposing edges at different speeds to shift a weft angle of the fabric as the fabric travels the length of the differential tenter frame;

reducing the distance between the opposing edges of the fabric as the weft angle of the fabric is shifted by the pair of opposing rails, each tapered towards one another; and simultaneously drying the fabric as the fabric travels the length of said differential tenter frame using a high velocity, drying range.

53. A method for producing a shifted angle fabric, said method comprising the steps of:

supplying a fabric;

receiving the opposing edges of the fabric on a differential tenter frame having a pair of opposing rails, and advancing the opposing edges at different speeds to shift a weft angle of the fabric as the fabric travels the length of the differential tenter frame;

reducing the distance between the opposing edges of the fabric as the weft angle of the fabric is shifted by the pair of opposing rails, each tapered towards one another;

simultaneously drying the fabric as the fabric travels the length of said differential tenter frame using a high velocity, drying range; and taking up the dried fabric downstream from said differential tenter frame.

* * * * *

UNITED STATES PATENT AND TRADEMARK OFFICE

CERTIFICATE OF CORRECTION

PATENT NO. : 8,296,911 B1
APPLICATION NO. : 12/553154
DATED : October 30, 2012
INVENTOR(S) : Jimmy L. Pruitt and Charles Albert Watson, Jr.

It is certified that error appears in the above-identified patent and that said Letters Patent is hereby corrected as shown below:

In Column 9, Line 45, 55145 should be "55/45"

Signed and Sealed this
First Day of January, 2013

David J. Kappos

David J. Kappos
*Director of the United States Patent and Trademark Office*